US007990260B2

(12) United States Patent
Ueda et al.

(10) Patent No.: US 7,990,260 B2
(45) Date of Patent: Aug. 2, 2011

(54) ELECTRIC DEVICE AND METHOD OF NORMALITY DETERMINATION FOR COMMUNICATION FUNCTION IN SUCH AN ELECTRIC DEVICE

(75) Inventors: Sunao Ueda, Osaka (JP); Yasuaki Miyaba, Osaka (JP); Hisashi Sumida, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 302 days.

(21) Appl. No.: 12/225,659

(22) PCT Filed: Mar. 19, 2007

(86) PCT No.: PCT/JP2007/055520

§ 371 (c)(1),
(2), (4) Date: Sep. 26, 2008

(87) PCT Pub. No.: WO2007/119424

PCT Pub. Date: Oct. 25, 2007

(65) Prior Publication Data

US 2009/0066508 A1 Mar. 12, 2009

(30) Foreign Application Priority Data

Mar. 27, 2006 (JP) ..... 2006-085903

(51) Int. Cl.
*G08B 26/00* (2006.01)
*G08B 29/00* (2006.01)

(52) U.S. Cl. ..... 340/505; 340/507; 340/512; 340/514

(58) Field of Classification Search ..... 340/505
See application file for complete search history.

(56) References Cited

U.S. PATENT DOCUMENTS

| | | | | |
|---|---|---|---|---|
| 3,516,063 | A * | 6/1970 | Sanders et al. | 340/3.3 |
| 4,088,983 | A * | 5/1978 | Crandall | 375/356 |
| 4,680,582 | A * | 7/1987 | Mejia | 340/3.21 |
| 6,290,141 | B1 | 9/2001 | Park et al. | |

FOREIGN PATENT DOCUMENTS

| | | | |
|---|---|---|---|
| CN | 1264812 | A | 8/2000 |
| JP | 5-157335 | A | 6/1993 |
| JP | 6-22117 | A | 1/1994 |
| JP | 9-149474 | A | 6/1997 |
| JP | 2000-28187 | A | 1/2000 |
| JP | 2001-289495 | A | 10/2001 |
| JP | 2002-372288 | A | 12/2002 |
| JP | 2003-56891 | | 2/2003 |

* cited by examiner

*Primary Examiner* — Donnie L Crosland
(74) *Attorney, Agent, or Firm* — Birch, Stewart, Kolasch & Birch, LLP

(57) ABSTRACT

A normality determination unit determines that a communication function for an outdoor unit of its own is normal when receiving a signal from one of indoor units, and writes a normality flag into an EEPROM. Further, the normality determination unit determines that it is not asserted that the communication function for the outdoor unit of its own is normal when not receiving a signal from any of the indoor units for a predetermined time period, and deletes the normality flag in the EEPROM.

4 Claims, 5 Drawing Sheets

ELECTRIC DEVICE AND METHOD OF NORMALITY DETERMINATION FOR COMMUNICATION FUNCTION IN SUCH AN ELECTRIC DEVICE

TECHNICAL FIELD

The present invention relates to an electric device and a method of normality determination for communication function in such an electric device.

BACKGROUND ART

A technique for determining whether an outdoor unit is in trouble or an indoor unit is in trouble when an air conditioning system stops its operation due to a communication error is disclosed in Patent Document 1 and Patent Document 2. With the technique described in Patent Document 1, a determination device that includes a pair of terminals respectively connectable with an indoor unit and an outdoor unit, a photocoupler means connected between the terminals, and a display means connected on a transistor side of the photocoupler means is connected to the outdoor unit or the indoor unit to form a closed circuit, and it is determined whether an adequate current flows using a display means, thereby a failure in the outdoor unit or the indoor unit is detected. In other words, an external determination device is used after the operation of the air conditioning system has been stopped.

The technique described in Patent Document 2 discloses examples such that a return circuit that returns a signal as-is from an indoor unit is connected externally to the indoor unit and that the return circuit is provided within the indoor unit. It is determined that the outdoor unit is in failure if a determination signal that has been transmitted from the indoor unit and returned via the outdoor unit is not the same as an original determination signal, and it is determined that the indoor unit is in failure if a determination signal that has been transmitted from the indoor unit and returned as-is from the return circuit is not the same as the original determination signal.

It should also be noted that a technique for discriminating between a temporary failure such as a noise due to thunder and a failure over a communication path is disclosed in Patent Document 3.

Patent Document 1: Japanese Patent Application Laid-Open No. 09-149474

Patent Document 2: Japanese Patent Application Laid-Open No. 2001-289495

Patent Document 3: Japanese Patent Application Laid-Open No. 2000-28187

DISCLOSURE OF THE INVENTION

Problems to be Solved by the Invention

However, the technique disclosed in Patent Document 1 has a problem that the number of steps required for determining the failure in an indoor unit and an outdoor unit may increase because the determination is carried out by connecting an external determination device after the error has occurred, and thus an amount of effort involved may also increase.

Further, the technique disclosed in Patent Document 2 has a problem that, while it is possible to provide a return circuit within an indoor unit, providing such an additional circuit may increase the cost.

Thus, an object of the present invention is to provide an electric device and a method of normality determination for communication function in such an electric device capable of carrying out normality determination for communication function without providing an external determination device and an additional circuit.

Means for Solving the Problems

A first aspect of an electric device according to the present invention is an electric device (10) that includes: a communication unit (12) configured to transmit and receive from a plurality of first electric devices (21 to 24), and a normality determination unit (11, 14) which determines, when a signal from at least one of the plurality of first electric devices is normally received, that a communication function for the electric device is normal (S2, S8).

A second aspect of the electric device according to the present invention is the electric device according to the first aspect, wherein the signal is a signal used in automatic address setting in which an address is assigned to each of the plurality of first electric devices (21 to 24).

A third aspect of the electric device according to the present invention is the electric device according to the first aspect, wherein the signal is a signal transmitted from each of the plurality of first electric devices at a predetermined interval, and the normality determination unit further determines, when a time period during which the signal fails to be received normally exceeds a predetermined time period, that it is not asserted that the communication function for the electric device is normal.

A fourth aspect of the electric device according to the present invention is the electric device according to any one of the first to third aspects, wherein the normality determination unit further determines, when the signal is normally received, that a communication function of one of the plurality of first electric devices that has sent the signal is normal.

A first aspect of a method of normality determination for communication function in an electric device according to the present invention is a method of normality determination for communication function in an electric device (10) configured to transmit and receive from a plurality of first electric devices (21 to 24), and the method includes: (a) a step of determining whether or not a signal from at least one of the plurality of first electric devices is normally received; and (b) a step of determining, when the signal is determined to be normally received in the step (a), that a communication function of the electric device is normal.

A second aspect of the method of normality determination for communication function in an electric device according to the present invention is the method of normality determination for communication function in an electric device according to the first aspect, wherein the signal is a signal used in automatic address setting in which an address is assigned to each of the plurality of first electric devices (21 to 24).

A third aspect of the method of normality determination for communication function in an electric device according to the present invention is the method of normality determination for communication function in an electric device according to the first aspect, wherein the signal is a signal transmitted from each of the plurality of first electric devices at a predetermined interval, and the method further comprises (c) a step of determining, when a time period during which the signal fails to be received normally exceeds a predetermined time period after the step (b), that it is not asserted that the communication function in the electric device is normal.

A fourth aspect of the method of normality determination for communication function in an electric device according to the present invention is the method of normality determination for communication function in an electric device according to any one of the first to third aspects, wherein the step (a) further determines, when the signal is normally received, that a communication function of one of the first plurality of electric devices that has sent the signal is normal.

Effect of the Invention

According to the first aspect of the electric device according to the present invention and the first aspect of the method of normality determination for communication function in an electric device, the normality determination of the communication function for the electric device is carried out during the communication. Therefore, it is possible to determine, when the communication is aborted due to an occurrence of an error, that the communication function for the electric device is normal without conducting determination of a cause of the error.

According to the second aspect of the electric device according to the present invention and the second aspect of the method of normality determination for communication function in an electric device, it is possible to determine that the communication function for the electric device is normal in response to a case where the automatic address setting is not possible due to improper wiring, noises, and such.

According to the third aspect of the electric device according to the present invention and the third aspect of the method of normality determination for communication function in an electric device, it is possible to improve accuracy in the normality determination during normal operation.

According to the fourth aspect of the electric device according to the present invention and the fourth aspect of the method of normality determination for communication function in an electric device, it is further possible to determine the normality of the communication function for the connected first electric device.

These and other objects, features, aspects and advantages of the present invention will be more apparent from the following detailed description with reference to the appended drawings.

BEST MODE FOR CARRYING OUT THE INVENTION

Embodiment

Figure 1:
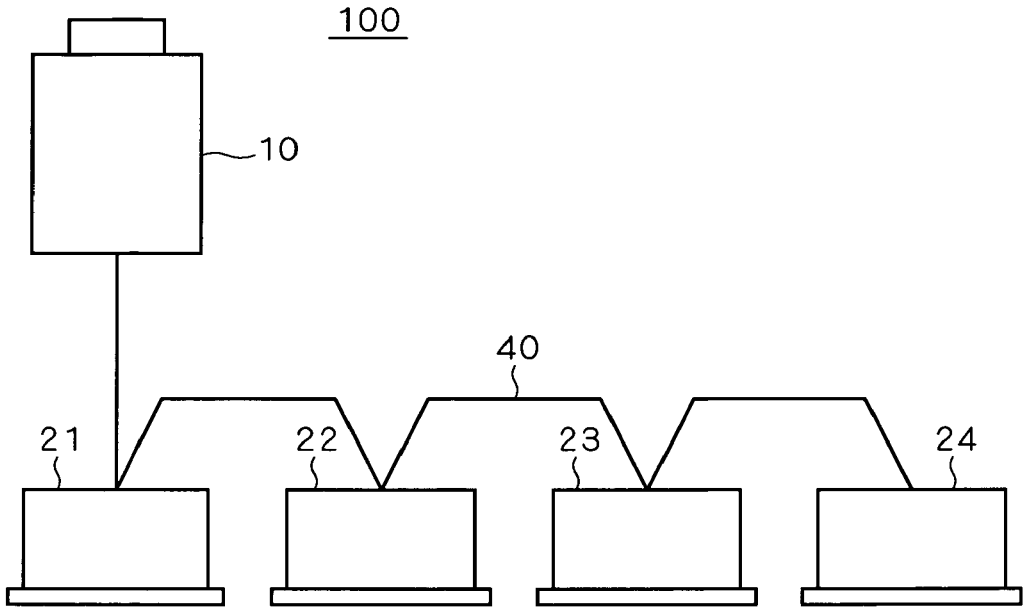
FIG. 1 is a schematic configuration diagram of an air conditioning system, illustrating one example of a system using an electric device according to the present invention.

A schematic configuration diagram of an air conditioning system as one example of a system using an electric device according to an embodiment of the present invention is shown in FIG. 1. An air conditioning system 100 is provided with a single outdoor unit 10 and a plurality of indoor units 21 to 24. The outdoor unit 10 and each of the indoor units 21 to 24 can communicate with each other via a communication line 40.

Figure 2:
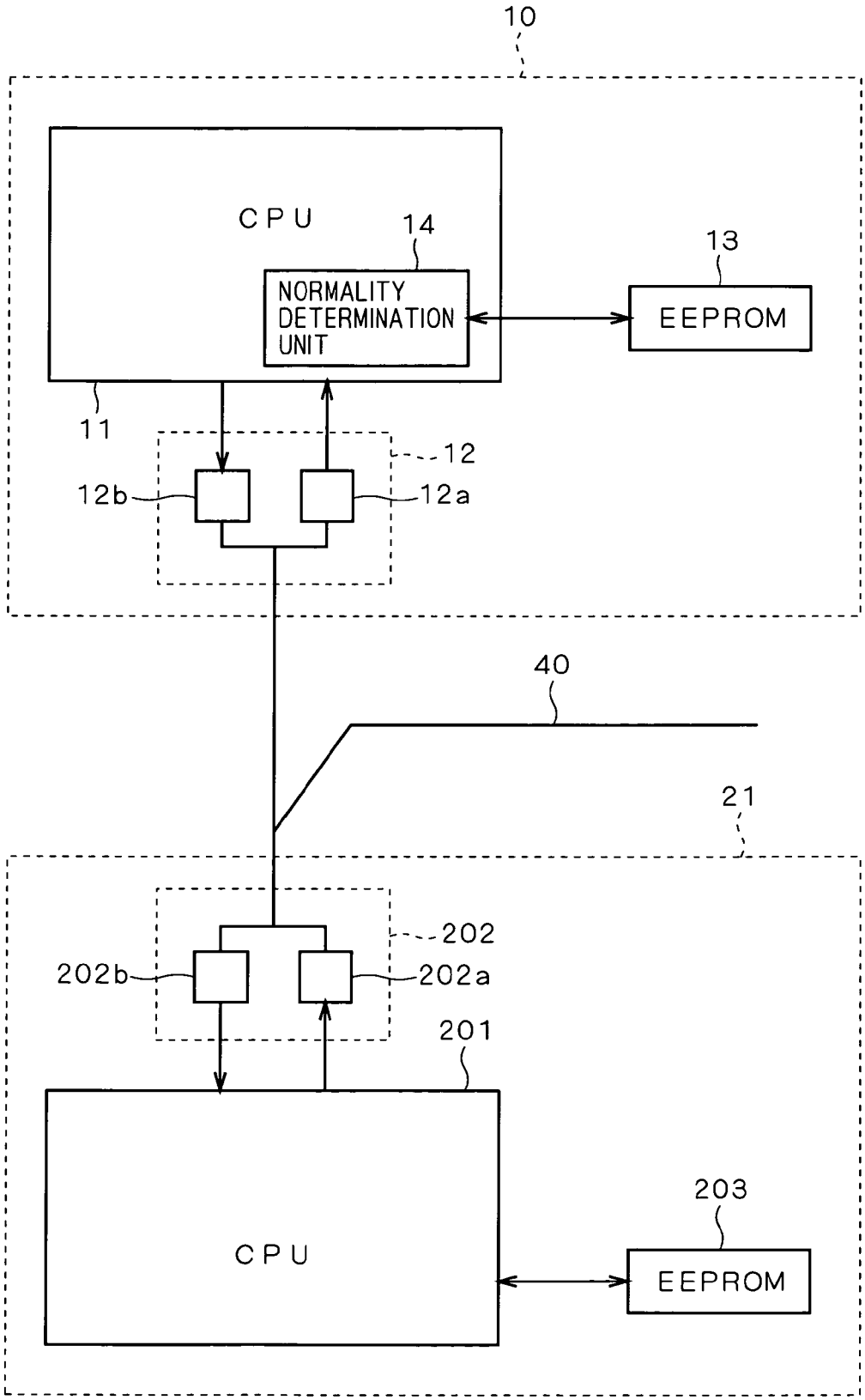
FIG. 2 is a schematic view illustrating an internal machinery of an outdoor unit and an indoor unit shown in FIG. 1.

FIG. 2 is a schematic view illustrating an internal machinery of the outdoor unit 10 and the indoor unit 21 shown in FIG. 1. The outdoor unit 10 is provided with a CPU 11, an EEPROM 13, and a communication unit 12. The CPU 11 serves functions of controlling each of the plurality of the indoor units 21 to 24, of setting an address for each of the indoor units 21 to 24, and of normality determination in which, when a signal from at least one of the indoor units 21 to 24 is normally received, a communication function of the outdoor unit 10 of its own is determined to be normal and a normality flag is written in the EEPROM 13. While these functions are realized by a program stored in a memory that is not shown in the drawings being executed by the CPU 11, the normality determination function is shown as being carried out by a normality determination unit 14 in FIG. 2 for reasons of expediency. Of course, the normality determination unit 14 may be provided as a component. Further, the CPU 11 may be considered as a normality determination unit. The communication unit 12 includes a reception unit 12*a* and a transmission unit 12*b*, and realizes reception and transmission with each of the indoor units 21 to 24.

Similarly, the indoor unit 21 is provided with a CPU 201, an EEPROM 203, and a communication unit 202. The CPU 201 serves a function of transmitting a response signal in response to a signal from the outdoor unit 10. A unique serial number that is provided upon production, an address for communication that is set for communication, and such are stored in the EEPROM 203. The communication unit 202 includes a transmission unit 202*a* and a reception unit 202*b*, and realizes reception and transmission with the outdoor unit 10. It should be noted that an internal configuration of the indoor units 22 to 24 is the same as that of the indoor unit 21.

The indoor units 21 to 24 and the outdoor unit 10 generally include a CPU and a communication unit in order that these units communicate with each other for operation. Further, in order to realize a unique operation, an EEPROM that stores data upon which the unique operation is based is normally provided. The present invention as described below may use such an existing unit.

During normal operation, because the outdoor unit 10 is required to transmit a control signal for controlling an operation of such as a compressor and a fan to each of the plurality of the indoor units 21 to 24, automatic address setting for automatically providing an address for communication to each indoor unit is carried out prior to normal operation. Specifically, the outdoor unit 10 transmits request signals for requesting a serial number to the indoor units 21 to 24, and receives response signals in response to the request signals respectively from the indoor units 21 to 24, thereby sequentially detecting serial numbers. An address for communication is set for each serial number thus detected. It should be noted that, in the following description, the above response signals are referred to as response signals for address setting.

Then, during normal operation, the outdoor unit 10 transmits a control signal for controlling an operation of such as a compressor and a fan to each of the plurality of the indoor units 21 to 24 based on each address, and the indoor units 21 to 24 each operates the compressor or the fan based on the control signal and transmit a response signal to the outdoor unit 10. The outdoor unit 10 recognizes that the operations of the indoor units 21 to 24 are performed normally by receiving the response signals. It should be noted that, in the following description, the above response signals are referred to as response signals for normal operation.

It should be noted that a communication situation is less favorable during address setting because congestion in communication occurs during address setting that is generally an initial operation during which the plurality of indoor units and the outdoor unit communicate. Therefore, in this embodiment, as described later, normality determination of the communication function for the outdoor unit 10 is carried out divided into two cases: a case in which an address has not yet been set (during address setting), and a case in which an address has already been set (during normal operation).

Figure 3:
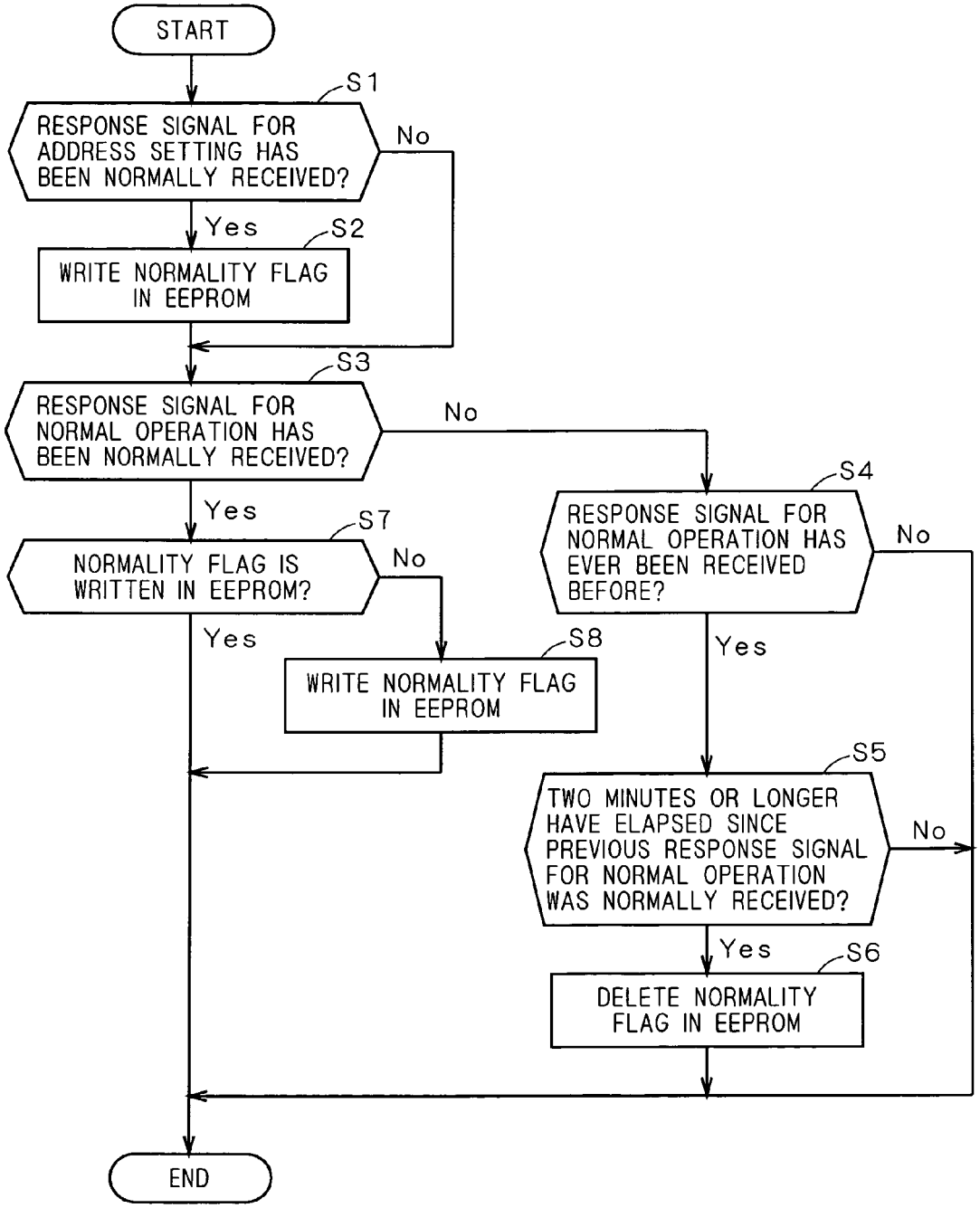
FIG. 3 is a flowchart showing an operation of normality determination of a communication function for the outdoor unit according to an embodiment.

Next, a characteristic operation of the air conditioning system is explained with reference to FIGS. 3, 4A, 4B, 4C and 4D. FIG. 3 is a flowchart showing an operation of the normality determination of the communication function for the outdoor unit 10 in the air conditioning system, and FIGS. 4A, 4B, 4C and 4D are diagrams showing fluctuation of normality flags according to the flowchart.

First, as shown in FIG. 3, in Step S1, the normality determination unit 14 determines whether or not the response signal for address setting transmitted from any one of the indoor units 21 to 24 has been normally received.

When the response signal for address setting is determined to have been normally received as a result of the determination in Step S1, in Step S2, the normality determination unit 14 determines that the communication function for the outdoor unit 10 of its own is normal and writes a normality flag in the EEPROM 13. Subsequently, Step S3 as described later is carried out.

When the response signal for address setting is determined to not have been normally received as the result of the determination in Step S1, Step S3 is carried out without going through Step S2. In this case, the normality flag is not written into the EEPROM 13.

In Step S3, the normality determination unit 14 determines whether or not the response signal for normal operation transmitted from any one of the indoor units 21 to 24 has been normally received.

When the response signal for normal operation is determined to have been normally received as a result of the determination in Step S3, the normality determination unit 14 reads the flag in the EEPROM 13 and determines whether or not the normality flag is written therein in Step S7.

When the normality flag is determined to be not written in as a result of the determination in Step S7, the normality determination unit 14 writes the normality flag in the EEPROM 13 in Step S8. When the normality flag is determined to be written in as the result of the determination in Step S7, the operation is terminated without going through Step S8. This operation is carried out in order to avoid overwriting of the normality flag into the EEPROM 13.

When the response signal for normal operation is determined to not have been normally received as the result of the determination in Step S3, the normality determination unit 14 determines, in Step S4, whether or not the response signal for normal operation has ever been received before. The operation is terminated if the response signal for normal operation is determined to not have been received as a result of the determination in Step S4, and Step S5 as described later is carried out if the response signal for normal operation is determined to have been received even once.

In Step S5, the normality determination unit 14 determines whether or not a time period during which no reception occurs exceeds a predetermined time period, for example, whether or not two minutes or longer have elapsed since a previous response signal for normal operation was normally received.

When it is determined that two minutes or longer have elapsed as a result of the determination in Step S5, in Step S6, the normality determination unit 14 determines that it is not asserted that the communication function for the outdoor unit 10 of its own is normal and deletes the normality flag in the EEPROM 13, and the operation is terminated.

When it is determined that two minutes or longer have not elapsed as the result of the determination in Step S5, the operation is terminated without going through Step S6. It should be noted that the operation of the normality determination of the communication function shown in FIG. 2 is carried out every time upon reception by the outdoor unit 10 and every predetermined time period. It should be noted that only Steps S3 to S8 can be carried out after address setting.

Figure 4A:
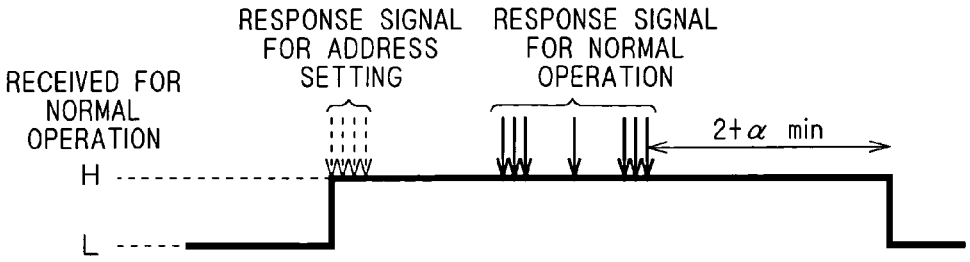
FIGS. 4A to 4D are diagrams illustrating normality flags according to the operation of the normality determination of the communication function in FIG. 3.
Figure 4B:
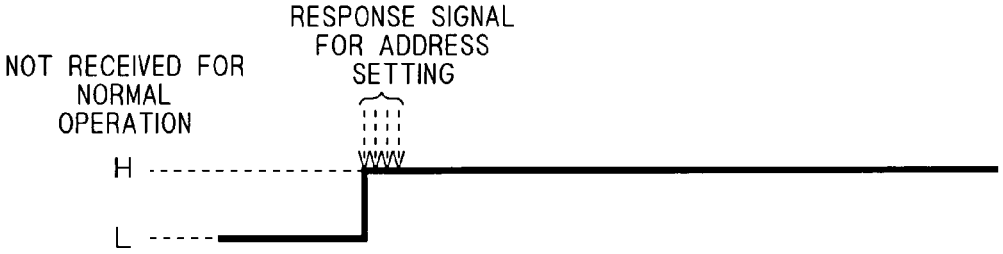
Figure 4C:
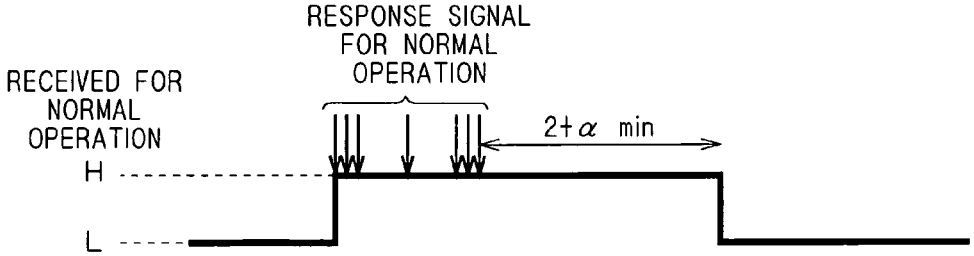
Figure 4D:
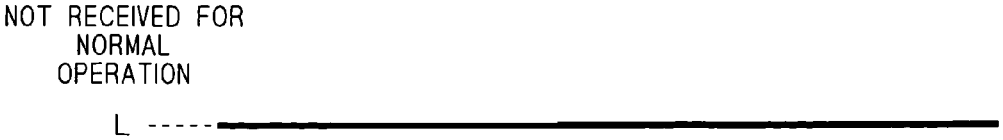

Next, with reference to FIGS. 4A, 4B, 4C and 4D, an overview of the fluctuation of the normality flags in the operation of the normality determination of the communication function for the normality determination unit 14 as described above is explained. FIGS. 4A and 4B show the fluctuation of the normality flags in a case when the address has not been set, and FIG. 4C and 4D show the fluctuation of the normality flags in a case when the address has been set. It should be noted that, in the drawings, arrows in broken line indicate the response signals for address setting, and arrows in solid line indicates the response signals for normal operation, respectively. Further, steps that should be especially referred to in the following description are shown in parentheses.

As shown in FIG. 4A, when the outdoor unit 10 normally receives the response signal for address setting for the first time from any one of the indoor units 21 to 24, for example, from the indoor unit 21, the normality determination unit 14 determines that the communication function for the outdoor unit 10 is normal, and sets the normality flag at high potential (H) (Steps S1, S2). Similarly, as the response signals for address setting are sequentially received respectively from the indoor units 21 to 24, address setting is normally completed for the corresponding indoor unit. Then, during normal operation, when the outdoor unit 10 receives the response signal for normal operation from any one of the indoor units 21 to 24, the normality flag remains at the high potential (H) (Steps S3, S7). Then, when the response signal for normal operation is not received for two minutes or longer after the previous response signal for normal operation has been received, the normality determination unit 14 determines that it is not asserted that the communication function for the outdoor unit 10 is normal, and sets the normality flag at low potential (L) (Steps S3, S4, S5, S6).

As shown in FIG. 4B, when the outdoor unit 10 normally receives the response signal for address setting, for example, from the indoor unit 21, the normality determination unit 14 determines that the communication function for the outdoor unit 10 is normal, and sets the normality flag at high potential (H) (Steps S1, S2). However, when the address setting is not completed normally due to improper wiring or noise, for example, it is not possible to move onto the normal operation after this, and the response signal for normal operation is never received, and therefore the normality flag remains at high potential (H) (Steps S3, S4). In this case, the normal operation is not possible even though the communication function for the outdoor unit 10 is normal.

As shown in FIG. 4C, in a case where the normality flag becomes at low potential (L) without receiving the response signal for normal operation for two minutes or longer after the address has been set and the response signal for normal operation has been received, and further when the outdoor unit 10 receives the response signal for normal operation from any one of the indoor units 21 to 24 during normal operation, the normality determination unit 14 determines that the communication function for the outdoor unit 10 is normal, and again sets the normality flag at high potential (H) (Steps S3, S7, S8). Then, when the response signal for normal operation has not been received for two minutes or longer since the previous response signal for normal operation has been received, the normality determination unit 14 determines that it is not asserted that the communication function for the outdoor unit 10 is normal, and again sets the normality flag at low potential (L) (Steps S3, S4, S5, S6).

As shown in FIG. 4D, in a case where the normality flag becomes at low potential (L) without receiving the response signal for normal operation for two minutes or longer after the address has been set and the response signal for normal operation has been received, and further when the outdoor unit 10 fails to normally receive the response signal for normal operation from the indoor units 21 to 24 during normal operation, the normality flag remains at low potential (L) (Steps S3, S4, S5, S6).

When an error occurs at any point in each case shown in FIGS. 4A to 4D, and when the normality flag at this point is at high potential (H), the communication function for the outdoor unit 10 can be determined to be normal. Further, even when the address setting is not normally completed due to improper wiring or noise while the address has not been set, the communication function for the outdoor unit 10 can be determined to be normal.

In this manner, it is possible to determine that the communication function for the outdoor unit 10 is normal without an external determination device and an additional circuit.

Modified Example

As a modified example of the embodiment, an aspect is explained for a case in which normality determination of a communication function for the indoor units 21 to 24 is carried out at the same time in addition to the normality determination of the communication function for the outdoor unit 10. A configuration of this air conditioning system is the same as the system shown in FIG. 1 as described in the embodiment. However, when a signal from at least one of the plurality of the indoor units 21 to 24 is normally received, the normality determination unit 14 determines that the communication function for the indoor unit that has transmitted the signal is normal as well as the communication function for the outdoor unit 10. Specifically, the normality determination unit 14 writes, in the EEPROM 13, a normality flag for each indoor unit that indicates the communication function for the indoor unit. It should be noted that, in the following, the normality flags indicating that the communication functions for the outdoor unit 10 and the indoor units 21 to 24 are normal are referred to as normality flags F0 to F4, respectively.

Figure 5:
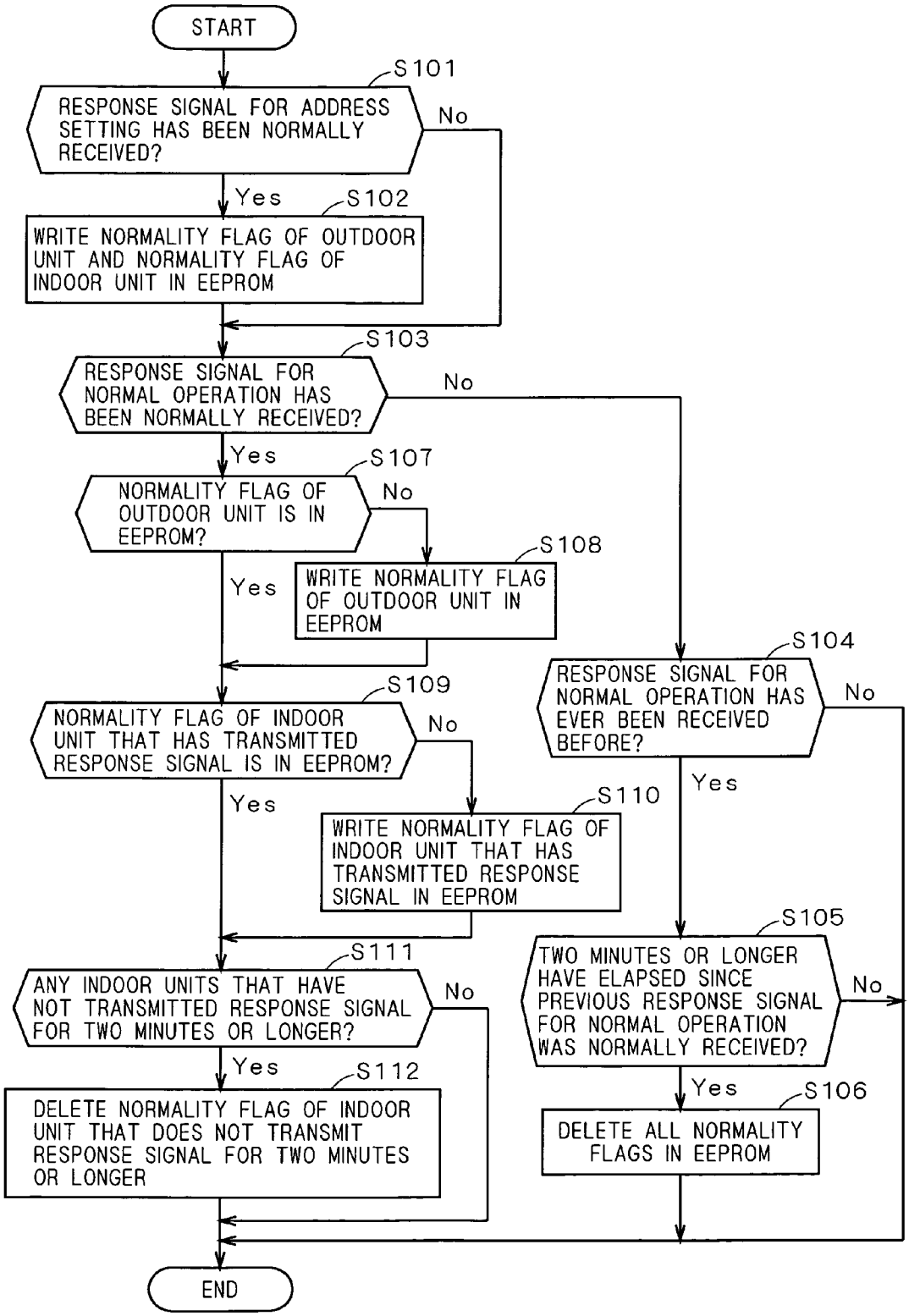
FIG. 5 is a flowchart showing an operation of the normality determination of the communication function for the outdoor unit according to a modified example.

Next, an operation of the normality determination of the communication function is explained with reference to a flowchart shown in FIG. 5. First, as shown in FIG. 5, in Step S101, the normality determination unit 14 determines whether or not the response signal for address setting transmitted from any one of the indoor units 21 to 24 has been normally received.

When the response signal for address setting is determined to have been normally received as a result of the determination in Step S101, the normality determination unit 14 determines that the communication functions for the outdoor unit 10 of its own and the indoor unit (for example, the indoor unit 21) that has transmitted the response signal are normal in Step S102, and writes the normality flag F0 and the normality flag F1 in the EEPROM 13.

When the response signal for address setting is determined to not have been normally received as the result of the determination in Step S101, Step S103 is carried out without going through Step S102. In this case, none of the normality flags is written into the EEPROM 13.

In Step S103, the normality determination unit 14 determines whether or not the response signal for normal operation transmitted from any one of the indoor units 21 to 24 has been normally received.

When the response signal for normal operation is determined to have been normally received as a result of the determination in Step S103, the normality determination unit 14 reads the flag in the EEPROM 13 and determines whether or not the normality flag F0 is written therein in Step S107.

When the normality flag F0 is determined to be not written in as a result of the determination in Step S107, the normality determination unit 14 writes the normality flag F0 in the EEPROM 13 in Step S108. When the normality flag F0 is determined. to be written in as the result of the determination in Step S107, Step S109 described later is carried out without going through Step S108. This operation is carried out in order to avoid overwriting of the normality flag F0 into the EEPROM 13.

Similarly, in Step S109, the normality determination unit 14 reads the flag in the EEPROM 13 and determines whether or not the normality flag F1 for the indoor unit (for example, the indoor unit 21) that has transmitted the response signal is written therein. When the normality flag F1 is determined to be not written in as a result of the determination in Step S109, the normality determination unit 14 writes the normality flag F1 in the EEPROM 13 in Step 5110. When the normality flag F1 is determined to be written in as the result of the determination in Step S109, Step S111 described later is carried out without going through Step S110. This operation is carried out in order to avoid overwriting of the normality flag F1 into the EEPROM 13.

In Step S111, the normality determination unit 14 determines, for example, whether or not there is any indoor unit that has not transmitted the response signal for two minutes or longer. When it is determined that the indoor unit 22, for example, has not transmitted the response signal for two minutes or longer to the outdoor unit 10 as a result of the determination in Step S111, in Step S112, the normality determination unit 14 determines that it is not asserted that the communication function for the indoor unit 22 is normal and deletes the normality flag F2 in the EEPROM 13, and the operation is terminated. When it is determined that there is no indoor unit that has not transmitted the response signal for two minutes or longer as the result of the determination in Step S111, the operation is terminated without going through Step S112.

When the response signal for normal operation is determined to not have been normally received as the result of the determination in Step S103, the normality determination unit 14 determines, in Step S104, whether or not the response signal for normal operation has ever been received before. The operation is terminated if the response signal for normal operation is determined to not have been received as a result of the determination in Step S104, and Step S105 as described later is carried out if the response signal for normal operation is determined to have been received even once.

In Step S105, the normality determination unit 14 determines whether or not a time period during which no reception occurs exceeds a predetermined time period, for example, whether or not two minutes or longer have elapsed since a previous response signal for normal operation was normally received.

When it is determined that two minutes or longer have elapsed as a result of the determination in Step S105, in Step S106, the normality determination unit 14 determines that it is not asserted that the communication function for the outdoor unit 10 of its own and the communication functions for all of the indoor units 21 to 24 are normal and deletes all of the normality flags F0 to F4 in the EEPROM 13, and the operation is terminated.

When it is determined that two minutes or longer have not elapsed as the result of the determination in Step S105, the operation is terminated without going through Step S106.

As described above, when the outdoor unit 10 receives the response signal from any one of the indoor units 21 to 24, it is further determined that the communication function for the indoor unit that has transmitted the response signal is normal. When the response signal from one of the indoor units 21 to 24 is not received for two minutes or longer, for example, it is further determined that it is not asserted that the communication function for the indoor unit is normal.

Thus, when an error occurs, by confirming the normality flag at this point, it is possible to determine that the communication function for the outdoor unit 10 is normal similarly to the embodiment, and it is further possible to determine that the communication functions for the indoor units 21 to 24 are normal.

Although the present invention is described in detail, the above description is illustrative only in every aspect, and the present invention is not limited to this description. A numerous modified examples that are not illustrated herein may be considered without departing the scope of the present invention.

The invention claimed is:

1. An electric device comprising:

a communication unit configured to transmit and receive from a plurality of first electric devices, and a normality determination unit which performs a first determination, when a first used in automatic address setting in which an address is assigned to each of said plurality of first electric devices from at least one of said plurality of first electric devices is normally received, that a communication function of said electric device is normal, performs a second determination, when a second signal used in normal communication from at least one of said plurality of first electric devices is normally received after said automatic address setting, that the communication function of said electric device is normal, and performs a third determination, when said second signal fails to be received from all of said plurality of first electric devices in a predetermined time period after said second signal is normally received, that it is not asserted that said communication function of said electric device is normal, and maintains said first determination when said second signal is never received normally from all of said plurality of first electric devices after said automatic address setting.

2. The electric device according to claim 1, wherein said normality determination unit determines that a communication function of one of said plurality of first electric devices is normal when said first signal or second signal is normally received from said one of said plurality of first electric devices, and that it is not asserted that said communication function of said one of said plurality of first electric devices is normal, when said second signal fails to be received from said one of said plurality of first electric devices in a second predetermined time period after said second signal is normally received from said one of said plurality of first electric devices.

3. A method of normality determination for communication function in an electric device for transmitting to and receiving from a plurality of first electric devices, the method comprising:

(a) a step of determining whether or not a first signal used in automatic address setting in which an address is assigned to each of said plurality of first electric devices is normally received from at least one of said plurality of first electric devices, (b) a step of determining, when said first signal is determined to be normally received in said step (a), that a communication function of said electric device is normal, (c) a step of determining whether or not a second signal used in normal communication after said automatic address setting is normally received from at least one of said plurality of first electric devices, after performing said step (b), (d) a step of determining, when said second signal is determined to be normally received in said step (c), that the communication function of said electric device is normal, (e) a step of determining, when said second signal is determined to not be normally received in said step (c), whether or not said second signal has ever been received before, (f) a step of determining, when the signal is determined to have been normally received in said step (e), whether or not a time period exceeds a predetermined time period after said second signal has been normally received before, (g) a step of determining, when the time period is determined to exceed said predetermined time period in said step (f), that it is not asserted that said communication function of said electric device is normal, and (h) a step of maintaining said determination in said step (b) when said second signal is determined to be never received in said step (e).

4. The method of normality determination for communication function in an electric device according to claim 3, wherein the communication function of said plurality of first electric devices having transmitted said first signal is determined to be normal in said step (b), and the communication function of said one of said plurality of first electric devices having transmitted said second signal is determined to be normal in said step (d), the method further comprising:

(i) a step of determining whether or not a time period exceeds a second predetermined time period after said second signal is normally received from said one of said plurality of first electric devices, and (i) a step of determining, when the time period is determined to exceed said second predetermined time period in said step (i), that it is not asserted that a communication function of said one of said plurality of first electric devices is normal.

* * * * *